United States Patent [19]

Bach et al.

[11] Patent Number: 5,013,969

[45] Date of Patent: May 7, 1991

[54] PROTECTIVE DEVICE FOR NEUTRON TUBES

[75] Inventors: Pierre Bach, Maisons Alfort; Henri Bernardet, Saint Michel Sur Orge, both of France

[73] Assignee: U.S. Philips Corporation, New York, N.Y.

[21] Appl. No.: 398,103

[22] Filed: Aug. 23, 1989

[30] Foreign Application Priority Data

Aug. 26, 1988 [FR] France ..... 88 11259

[51] Int. Cl.[5] ..... H05B 41/36

[52] U.S. Cl. ..... 315/61; 315/53; 315/58; 315/299

[58] Field of Search ..... 315/51, 52, 53, 54, 315/58, 59, 61, 62, 111.81, 111.91, 291, 299, 306

[56] References Cited

U.S. PATENT DOCUMENTS

| | | | |
|---|---|---|---|
| 2,951,945 | 9/1960 | Goodman | 250/84.5 |
| 2,988,671 | 6/1961 | Arnold | 315/200 R X |
| 3,364,355 | 1/1968 | Ruby et al. | 313/249 X |
| 3,581,093 | 5/1971 | Carr | 250/84.5 |
| 3,784,824 | 1/1974 | Reifenschweiler | 250/84.5 |
| 3,836,785 | 9/1974 | Reifenschweiler | 250/501 |
| 4,808,368 | 2/1989 | Humphreys | 315/176 X |

*Primary Examiner*—David Mis

*Attorney, Agent, or Firm*—Robert J. Kraus

[57] ABSTRACT

A protective device for a neutron tube including an ion source having an anode (2) which is brought to a positive potential relative to a cathode (3) by means of a source supply. An ion beam accelerated by means of an acceleration electrode (5) strikes a target (6) disposed on an insulating support (9) and brought to a negative potential supplied by an HT supply. The protective device includes electric elements (11, 12) limiting the tube current and/or the target voltage, which are made unalterable by enclosing them inside the neutron tube, so that any attempt to modify the electrical parameters determining the normal operating conditions of the tube necessitates the opening of the tube.

11 Claims, 6 Drawing Sheets

PROTECTIVE DEVICE FOR NEUTRON TUBES

BACKGROUND OF THE INVENTION

The invention relates to a protective device for a neutron tube comprising an ion source whose anode is brought to a positive potential relative to the cathode by means of a source supply, and whose accelerated ion beam strikes a target disposed on an insulating support and brought to a negative potential supplied by a high tension (HT) supply, said protective device being composed of electric elements limiting the tube current and/or the target voltage.

In their usual application neutron tubes operate under conditions compatible with the ability to dissipate heat, particularly from the target and its support.

Their specifications are in addition designed for wide-dynamic operating modes:

continuous mode operation necessitates dimensioning dictated by the insulation;

rapid recurrence, pulsating mode operation leads to extraction structures permitting relatively high ionic currents.

The ion sources themselves, which are often of the Penning type, are provided with extraction apertures of fairly large dimensions in order to make it possible to obtain a high extraction yield with a low operating pressure. Furthermore, they can operate under arc type discharge conditions with pressure values which are still compatible with operation of the tube, and the very high voltages which can be applied to these tubes may make it possible to extract large ionic currents during short periods of time.

All these considerations show that, particularly for tubes of small dimensions, it is possible to use a neutron tube considerably beyond its nominal use, for example for utilization with an intense pulsating neutron flux. This can be achieved by:

increasing the tube current by means of an increase of the discharge current of the ion source under arc operating conditions, with a higher anode voltage;

a possible increase of the target voltage by a factor close to 1.5.

The electrical limiters usually installed in the supply circuits of the ion source anode and of the target for the purpose of protecting the supply and the tube can be dispensed with and replaced by new elements suitable for a new use.

SUMMARY OF THE INVENTION

The invention seeks to provide the manufacturer of the tube with a means of avoiding such changes.

To this end the invention is remarkable in that said limiters are made unalterable by enclosing said elements inside the neutron tube, so that any attempt to modify the electrical parameters determining the nominal operating conditions of the tube necessitates the opening of the tube.

The tube current limiter elements comprise a resistor connected between the positive terminal of the source supply and the anode of the ion source, as well as a limiter setting a boundary value on the voltage slightly higher than the specified value and connected between said positive terminal and the negative terminal of the earthed source supply.

The resistor and the voltage limiter can be placed inside a leaktight casing fed through leaktight passages, or in a sealed glass bulb. They can be produced by screen printing technology, or may consist of mixed arrangements of screen printed elements and discrete components compatible with the quality of the vacuum required for the neutron tube.

The target voltage is limited by a resistor connected between the negative terminal of the HT supply and the target, and by a voltage limiter connected between the negative terminal and the positive terminal of the earthed HT supply. The resistor may consist of one of the following forms:

a screen printed resistor disposed helically on the outer face of an insulating cylinder serving as a support for the target;

an insulated resistive wire (high temperature technology) wound turn-to-turn or in the form of a pancake coil;

high tension resistive elements in series, disposed inside an envelope of alumina (or any other insulating material compatible with tube technology and VHT requirements), which may either be in communication with the tube or in a gas atmosphere depending on the technology of the resistive elements (temperature characteristics, degassing), the method of connection and assembly (electric field in resistors and connection wires), and the maximum level of voltage drop accepted in the resistor by the manufacturer.

BRIEF DESCRIPTION OF THE DRAWING

The invention will be better understood with the aid of the following description of some forms of construction of devices, which are given as non-limitative examples, this description being accompanied by drawing figures, in which.

Elements corresponding to one another in these drawings are indicated by the same reference numerals.

DESCRIPTION OF PREFERRED EMBODIMENTS

Figure 1:
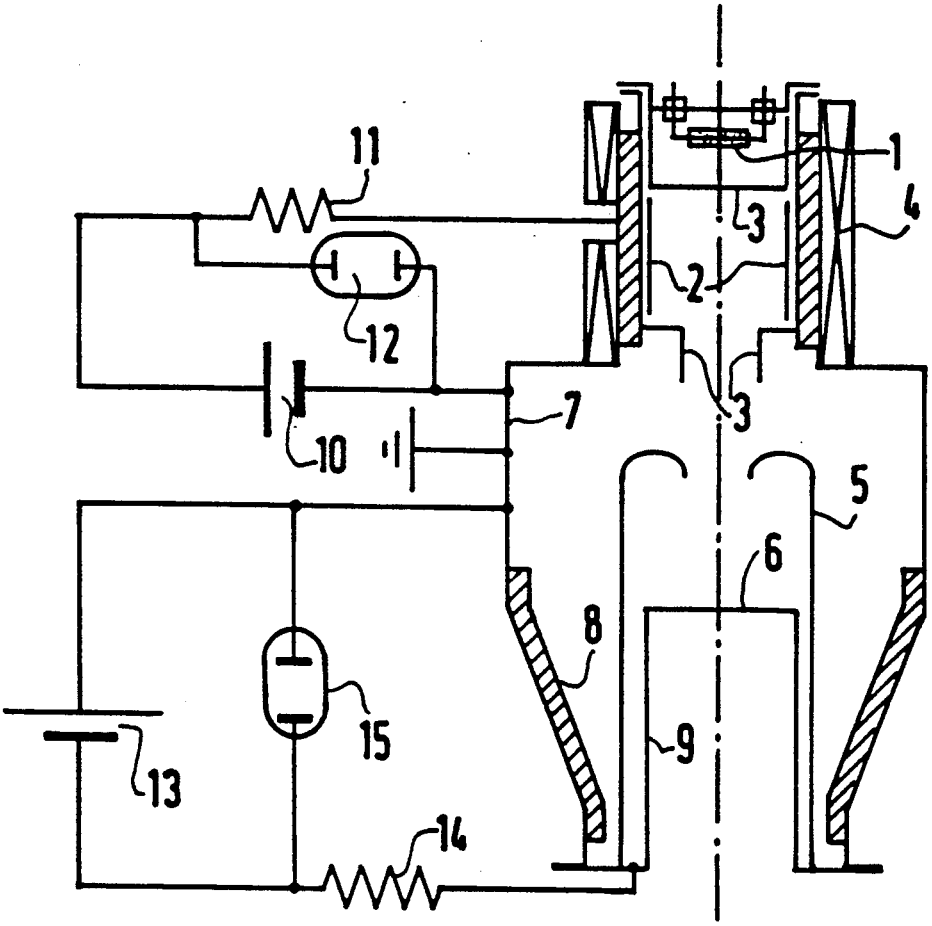
FIG. 1 is a basic diagram of the neutron tube supplies provided with current and voltage limiter elements.

The neutron tube shown in FIG. 1 is provided with a source of ions obtained from a mixture of deuterium and tritium contained in the reservoir 1, this source including an anode 2, a cathode 3 and a permanent magnet 4 which produces an axial magnetic field. The ion beam coming from this source is accelerated by the acceleration electrode 5 and strikes the target 6. The tube envelope is composed of an earthed conductive part 7 and an insulating part 8 surrounding the target support 9 fastened to the acceleration electrode.

The above description relates to a Penning type tube, but it can easily be extended to other types of tubes (electrostatic confinement, multi-cusp, and so on).

The ion source is supplied by the direct voltage generator 10 whose value is $V_{aa}$ and whose negative pole is connected to the earth of the tube, while its positive pole is connected to the anode 2 via the resistor 11, whose value is $R_a$.

The discharge current in the neutron tube can be subdivided schematically into two operating conditions:

low pressure operation for which the discharge current $I_d$ varies in dependence on the pressure $P_{DT}$ inside the tube and on the anode-cathode voltage $V_{ak}$ in accordance with the relation:

$$I_d \propto P_{DT}^{\gamma} V_{ak}^{\nu}$$

where $\gamma$ and $\nu$ are close to 1. This relation shows that the increase of the discharge current is obtained by an increase of the pressure $P_{DT}$ with an upper limit corresponding to arc operation, or by an increase of the anode-cathode voltage $V_{ak}$; in the latter case it is necessary to increase the magnetic field B in such a manner as to maintain a constant ratio $V_{ak}/B$.

a strong current operation corresponding to arc operation; in this case the discharge current is in practice limited by the external supply circuit and the voltage $V_{ak}o$ at the terminals of the anode-cathode structure is almost constant. The following therefore applies:

$$V_{aa} = R_a I_d + V_{ak}o.$$

The current $I_d$ is then given by:

$$Id = \frac{V_{aa} - V_{ak}o}{R_a}$$

In both types of operation the current $I_d$ is limited by the supply voltage $V_{aa}$ and by the resistance $R_a$.

The devices forming the object of the invention will therefore make it possible to act on these two parameters and will include the resistor 11 having the value $R_a$ compatible with the maximum instantaneous flux provided for by the manufacturer, and a voltage limiter 12 (discharger, varistor, gas diode) having the impedance $Z_a$ and connected to the supply terminals 10, limiting the operating voltage to a value slightly higher than the supply voltage desired by the manufacturer and ensuring good reliability of the tube.

Taking into account the rapid evolution of the neutron emission in dependence on the target voltage, a system based on the same principle as that employed for the anode is possible; it comprises the direct voltage generator 13 which has the value $V_{ac}$ and whose positive pole is earthed, while its negative pole is connected to the acceleration electrode via the resistor 14 having the value $R_c$. This limitation of the target current $I_c$ may be supplemented by voltage limitation by means of a limiter 15 (discharger or varistor) having the impedance $Z_c$ and connected to the terminals of the current generator 13.

The limiter devices shown schematically in FIG. 1 may be used simultaneously or separately; they are of two types:

tube current limitation by limiting the current of the ion source, target voltage limitation by limiting the supply voltage of the target.

The corresponding structures are dependent on the structure of the tube and the descriptions given (types of components, examples of location) constitute only non-limitative illustrations. A point common to all the solutions adopted is their compatibility with requirements, particularly thermal requirements, resulting from the technology for the production of the tubes.

Before details are given of some examples of limiter devices of the two types, it will be recalled that the instantaneous neutron emission $Q_n$ is globally linked to the electric parameters: tube current $I_T$U and target voltage $V_c$ by a relation of the type:

$$Q_n \approx K\, I_{TU} V^{\beta}_{c},$$

where $0.3 < k < 1$ and $3 < \beta < 4$ for $80\ kV < V_c < 150\ kV$. This is valid for $I_{TU}$ expressed in amperes, $V_c$ in kilovolts, $Q_n$ in neutrons/second, and for pressures of the hydrogenated gas mixture lower than or equal to $10^{-2}$ torr.

Figure 2A:
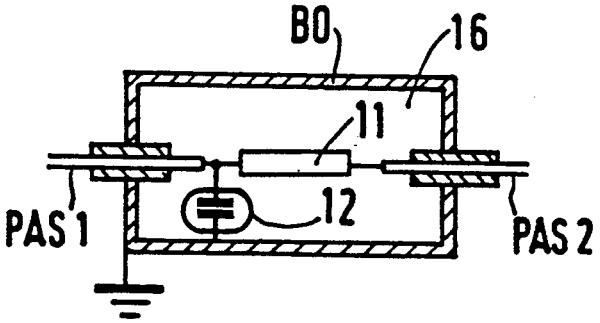
FIGS. 2*a*, 2*b* and 2*c* show some forms of construction of tube current limiter elements.
Figure 2B:
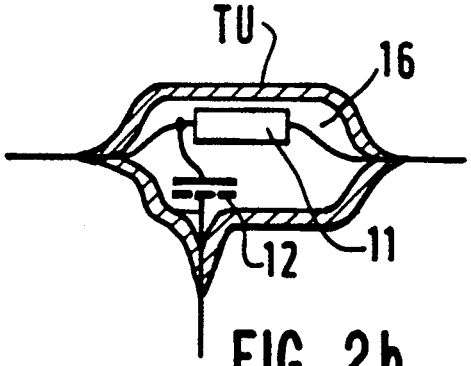
Figure 2C:
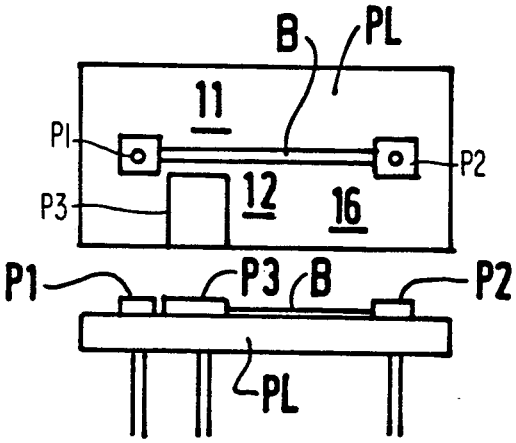

The tube current limiter elements can be disposed so as to form a single limiter assembly 16. FIGS. 2*a*, 2*b* and 2*c* show some examples of arrangements.

In FIG. 2*a* the resistor 11 and the voltage limiter 12 are disposed in a leaktight casing BO supplied through leaktight passages PAS1 and PAS2.

In FIG. 2*b* the resistor 11 and the voltage limiter 12 are placed in a sealed tube TU.

In FIG. 2*c* the resistor 11 and the breakdown type voltage limiter 12 are produced by screen printing technology and must be compatible with the quality of vacuum indispensable to a neutron tube. The resistor 11 consists of a screen printed bar B between the supply contacts $P_1$ and $P_2$; the discharger 12 is composed of the groove gap situated between the contact $P_1$ and the contact $P_3$ or between the bar B and the contact $P_3$. The whole arrangement is deposited on the insulating plate PL (alumina, glass) and is compatible with the technology of the tube (high temperature and low degassing rate).

Figure 3:
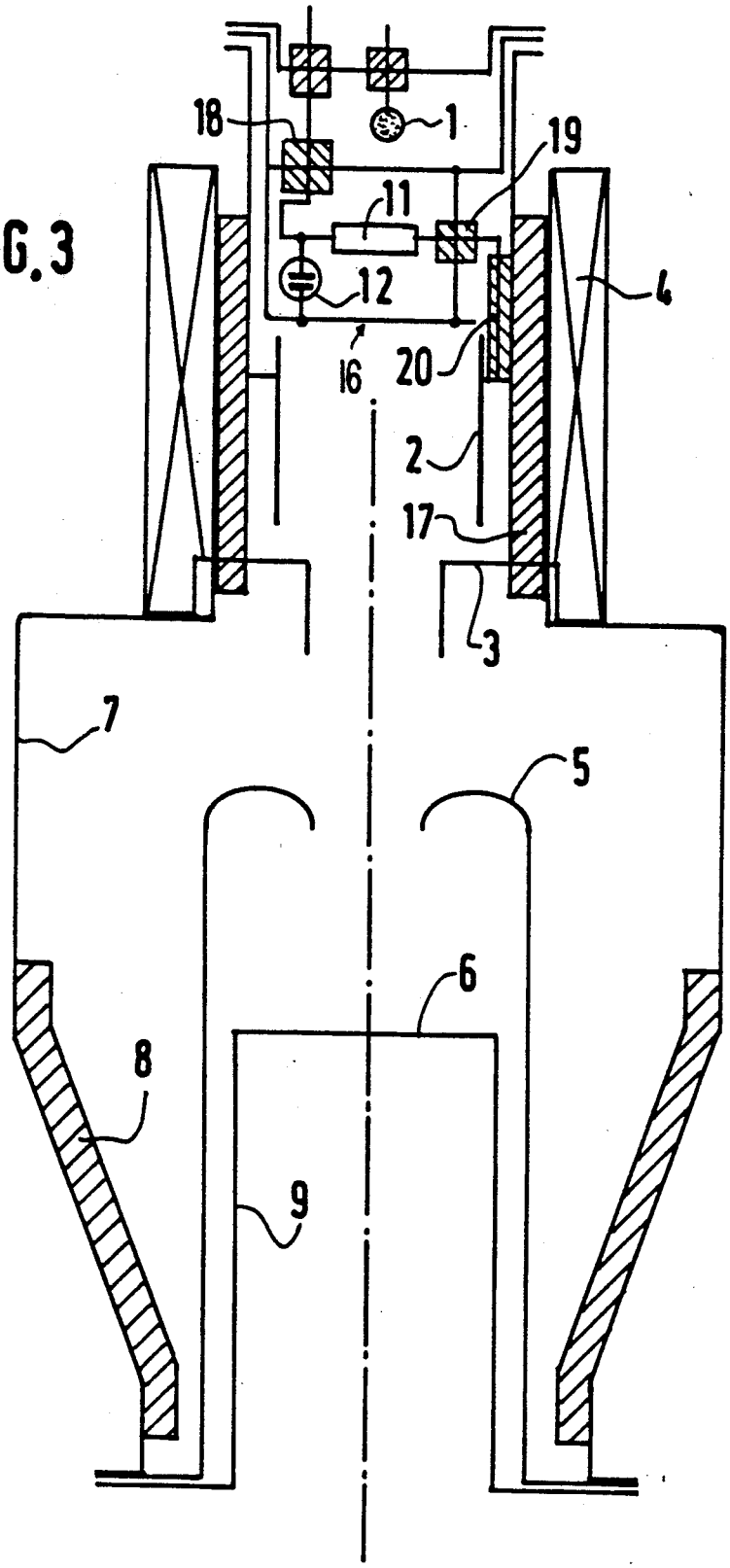
FIGS. 3 and 4 show respectively a first and a second example of the arrangement of current limiter elements in the neutron tube.
Figure 4:
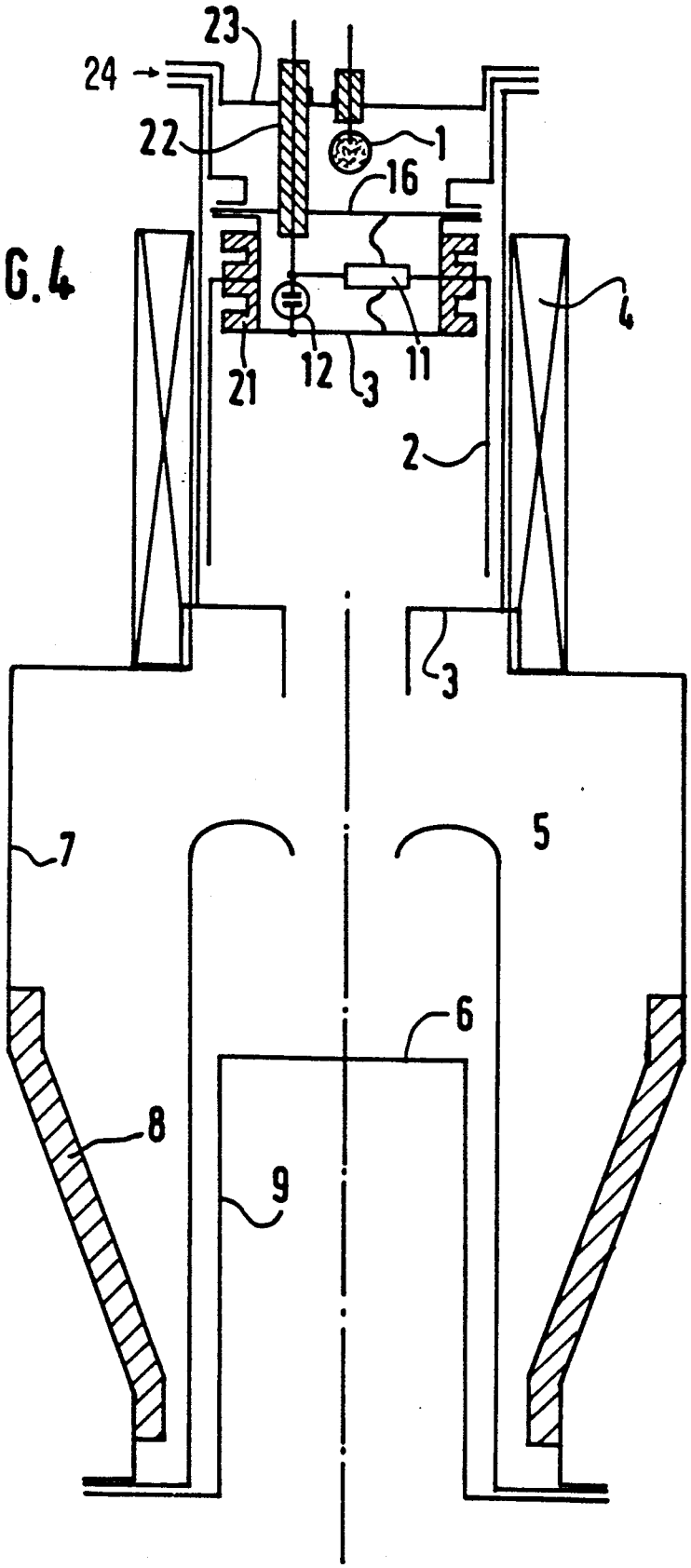

FIGS. 3 and 4 show two examples of the arrangement of the anode current limiter assembly inside the actual neutron tube according to the invention.

In FIG. 3 the anode 2 is mechanically held by the insulating wall 17 on the ion source side. The leaktight casing of the limiter assembly 16 containing the limiter elements 11 and 12 is provided with insulating outlets 18 and 19 serving respectively for its voltage supply and for its connection to the anode; this connection is protected by an insulating sleeve 20.

In FIG. 4 the anode is mounted directly on the leaktight casing of the limiter assembly 16 with the aid of the insulating support 21, through which the connection of the limiter resistor 11 to the anode 2 is made; the discharger (or varistor) 12 is connected to the voltage supply through the insulated passage 22. The casing of the limiter assembly 16 is connected to the support of the reservoir 23 and to the tube frame 7 by a "three-lip" soldered joint 24.

The limiter assembly 16 may be produced by using different types of components, by direct mounting of discrete components (resistor, discharger) connected in parallel in the foot of the tube; the technology of these components must be compatible with ultrahigh vacuum. Mixed arrangements of screen printed elements and discrete components may also be assembled in dependence on their compatibility with ultrahigh vacuum.

Taking into account the rapid evolution of the neutron emission in dependence on the target voltage, a system utilizing the same principle as that employed for the anode is obtained with the aid of a high voltage resistor, which can be produced in different forms.

Figure 5:
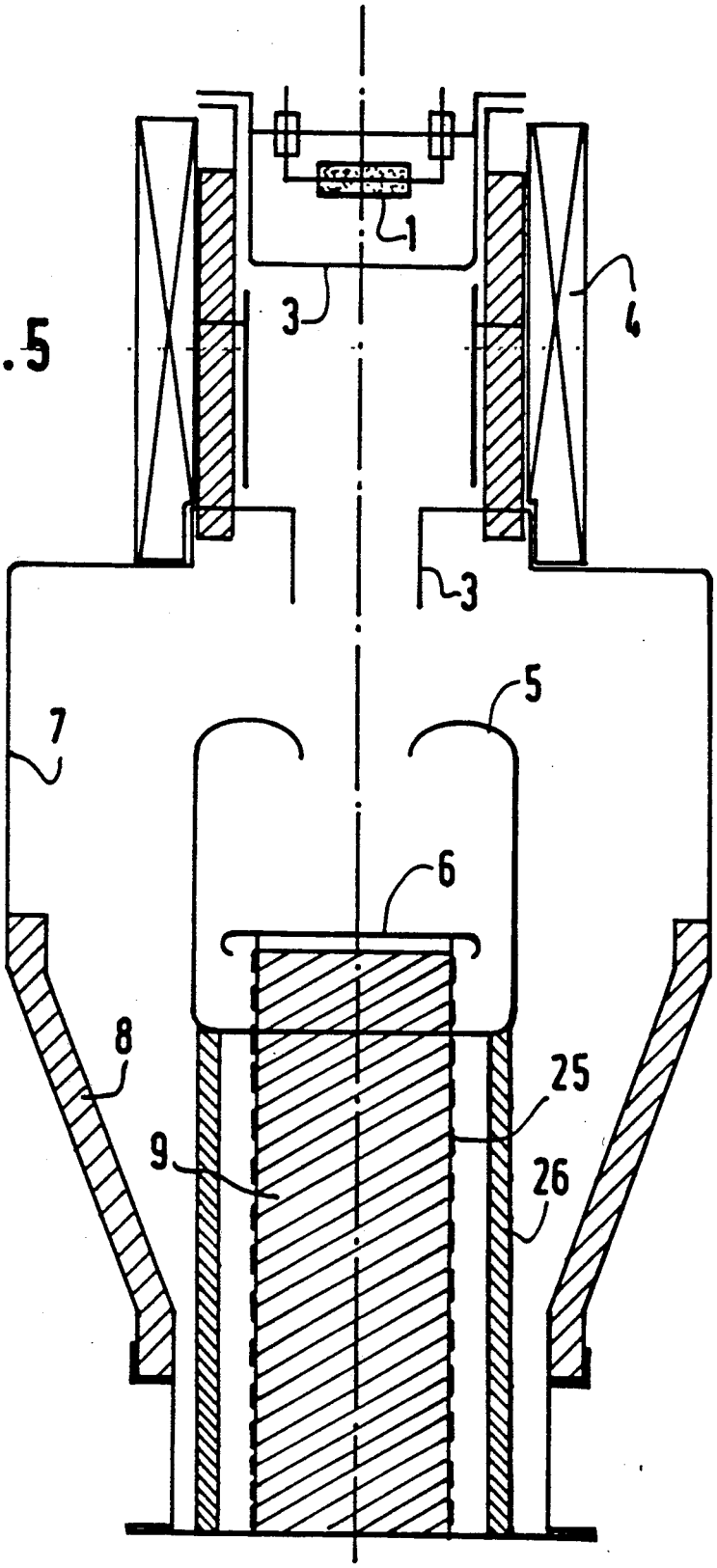
FIG. 5 shows an example of the arrangement of the target voltage limiter elements around the target support.

In FIG. 5 a resistor 25 is disposed on the outside of the insulating cylinder 9 serving as support for the target 6; the end situated at the base of the cylinder is connected to the negative pole of the high tension supply, and the end situated at the top of the cylinder is connected to the acceleration electrode 5.

This resistor 25 may for example be composed of screen printed elements deposited on the outside of the cylinder 9 in the form of a helix or of insulated resistive wire according to high temperature technology, and wound turn-to-turn or in pancake form.

The acceleration electrode 5 is held by the insulating support 26.

Figure 6:
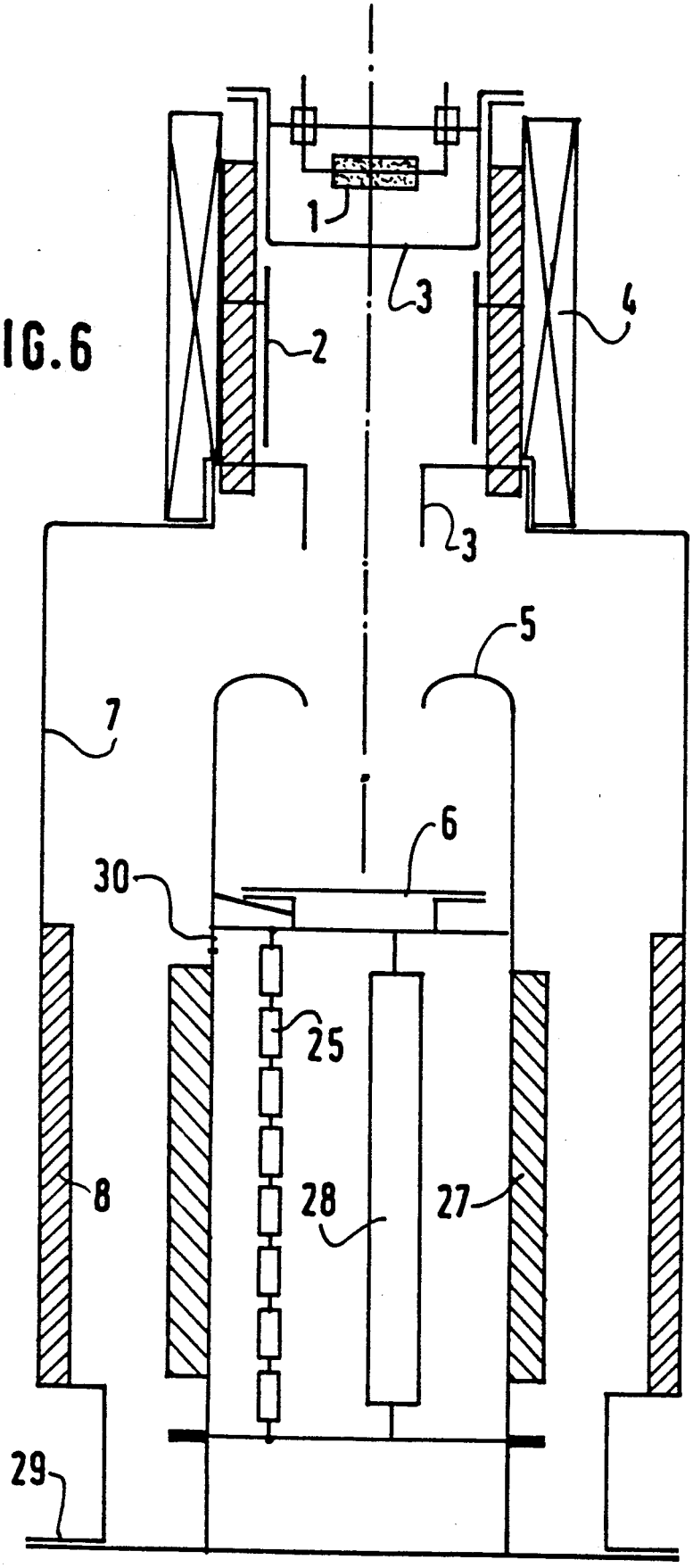
FIG. 6 shows another example of the arrangement of the target voltage limiter elements inside an insulating envelope.

In FIG. 6 the resistor 25 is formed of resistors in series which are deposited inside an alumina envelope 27 serving as support for the acceleration electrode 5 connected to the top end of the resistor, the target 6 also being supported by the envelope 27.

This limitation of current by means of the resistor 25 can be supplemented by voltage limitation by means of a discharger (or a varistor) 28 disposed inside the alumina envelope and connected between earth and the "three-lip" soldered joint 29 connected to the negative pole of the HT target supply.

The interior of the alumina envelope 27 may either be in communication with the tube or be in a gas atmosphere, depending on whether the aperture 30 is open or closed. The solution will depend on the compatibility of the varistors and resistors with ultrahigh vacuum, and on the technology of the resistors (temperature characteristics, degassing). The target voltage limitation elements could for example be placed in a controlled atmosphere of a gas of the sulphur hexa-fluoride type under a pressure of a few bars.

We claim:

1. In a neutron tube comprising a target, an ion source for producing an ion beam, and means for accelerating the ion beam toward the target, said tube having predefined operating current and operating voltage magnitudes, the improvement comprising protective means for limiting at least the operating current to said predefined magnitude when a supply voltage is applied to first and second connection means of the tube, said protective means including at least a current limiter device electrically connected to said first and second connection means and contained in the neutron tube such that the tube cannot be made operable above at least said predefined current magnitude without opening the tube.

2. A neutron tube as in claim 1 where the current limiter device comprises:

a. an anode resistor electrically connected in series with the first connection means and an anode of the ion source, and b. voltage limiting means electrically connected to the first and second connection means for limiting the supply voltage to the predefined magnitude.

3. A neutron tube as in claim 2 where the current limiter device comprises a sealed casing containing the anode resistor and the voltage limiting means and including leak tight feedthrough means for making electrical connections to said anode resistor and voltage limiting means.

4. A neutron tube as in claim 2 where the current limiter device comprises a sealed glass envelope containing the anode resistor and the voltage limiting means.

5. A neutron tube as in claim 2 where the current limiter device comprises a printed circuit disposed on an insulating base, said anode resistor comprising a screen printed bar and said voltage limiting means comprising first and second conductive elements defining a gap therebetween, said first and second conductive elements being electrically connected to the first and second connection means.

6. A neutron tube as in claim 2 where the current limiter device comprises at least one screen printed electrical element and at least one discrete electrical element.

7. A neutron tube as in claim 1 where the current limiter device comprises:

a. a target resistor electrically connected in series with the first connection means and the target; and b. voltage limiting means electrically connected to the first and second connection means for limiting the supply voltage to the predefined magnitude.

8. A neutron tube as in claim 7 including an insulating cylindrical base on which the target is supported, said target resistor being helically disposed on an outer surface of said cylindrical base.

9. A neutron tube as in claim 8 where the target resistor is screen printed on said outer surface.

10. A neutron tube as in claim 7 where the target resistor comprises a plurality of electrically connected discrete resistive elements disposed inside an insulating envelope.

11. A neutron tube as in claim 10 where the insulating envelope consists essentially of alumina.

* * * * *